US005478297A

United States Patent [19]

Dennis, Jr.

[11] Patent Number: 5,478,297

[45] Date of Patent: Dec. 26, 1995

[54] HIGH SPEED JUMP ROPE

[76] Inventor: David B. Dennis, Jr., P.O. Box 4927, Pagosa Springs, Colo. 81147

[21] Appl. No.: 445,240

[22] Filed: Dec. 4, 1989

[51] Int. Cl.[6] ..... A63B 5/20

[52] U.S. Cl. ..... 482/82; 482/81

[58] Field of Search ..... 272/74, 75, 125; 482/81–82

[56] References Cited

U.S. PATENT DOCUMENTS

| | | | |
|---|---|---|---|
| 1,462,088 | 7/1923 | La Sares | 272/75 |
| 2,869,872 | 1/1959 | Nissen . | |
| 4,101,123 | 7/1978 | Anthony . | |
| 4,136,866 | 1/1979 | Bouvier . | |
| 4,179,119 | 12/1979 | Wolf | 272/75 |
| 4,293,125 | 10/1981 | Hinds | 272/75 |
| 4,385,759 | 5/1983 | Everroad . | |
| 4,647,037 | 3/1987 | Donohue | 272/75 |
| 4,736,945 | 4/1988 | Vinciguerra | 272/75 |
| 4,778,173 | 10/1988 | Joutras | 272/75 |
| 4,919,417 | 4/1990 | Poulas | 272/75 |

FOREIGN PATENT DOCUMENTS 911713 5/1954 Germany .

*Primary Examiner*—Stephen R. Crow
*Attorney, Agent, or Firm*—Jim Zegeer

[57] ABSTRACT

A jump rope has a spindle rod with two off-set of center parallel cord receiving holes running through its entire length spins freely within a grip handle allowing the cord to rotate free of friction that would cause it to twist and deteriorate. The off-set holes act as a crank mechanism allowing for more efficient cord rotation energy transfer, provide a place to store cord ends (means of length adjustment), and they allow for use of two ropes, and also could be used as a place to mount end caps. There are several cord length and configuration adjustment embodiments disclosed. One adjustment is by frictionally clamping the cord in a notch in an end cap. This feature stabilizes the cord at a desired length and also sets the cord off at about a 90 degree angle from the handles which, by acting as a crank, allows for more efficient and effective use of cord rotation energy. Another adjustment feature works by simply inserting excess cord length in the empty off-set spindle rod holes. Cord length adjustments can also be made with the use of cord clamps. The cord can also be adjusted lengthwise and/or angled in several configurations by inserting it through holes provided for this purpose in both end caps of both handles.

26 Claims, 2 Drawing Sheets

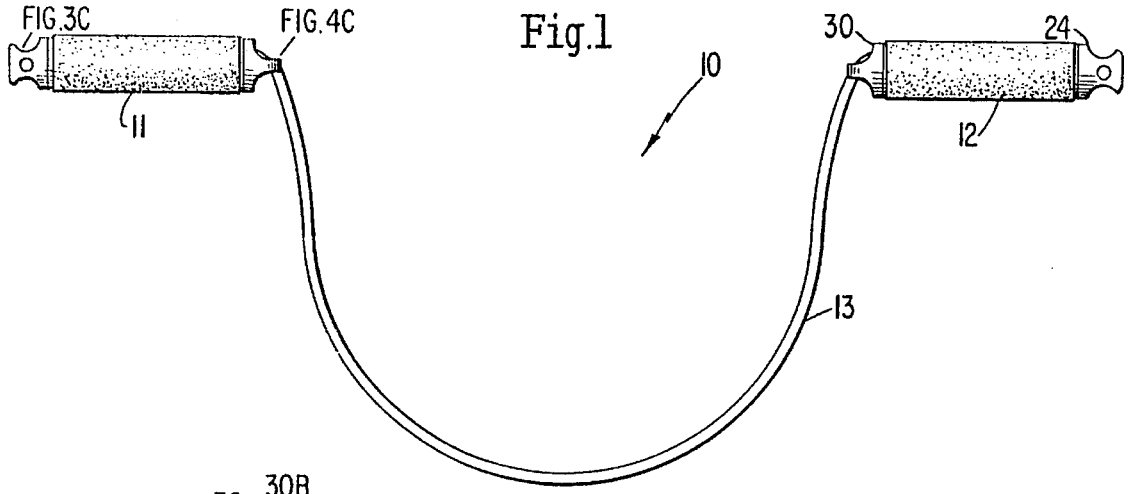
Fig.1
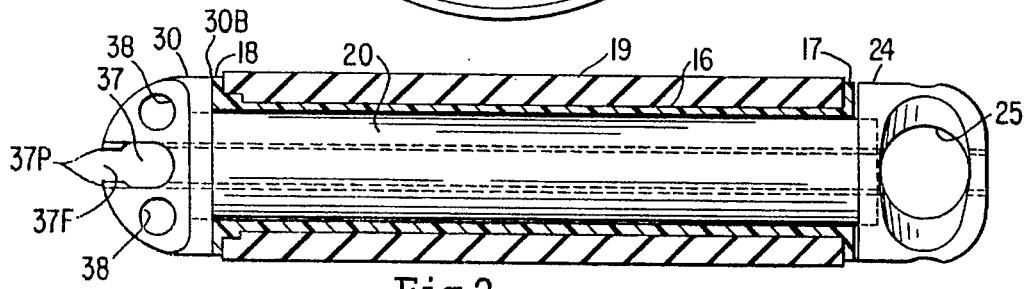
Fig.2
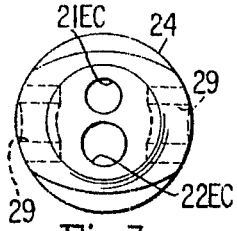
Fig.3a
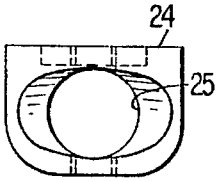
Fig.3b
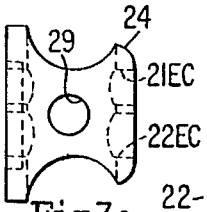
Fig.3c
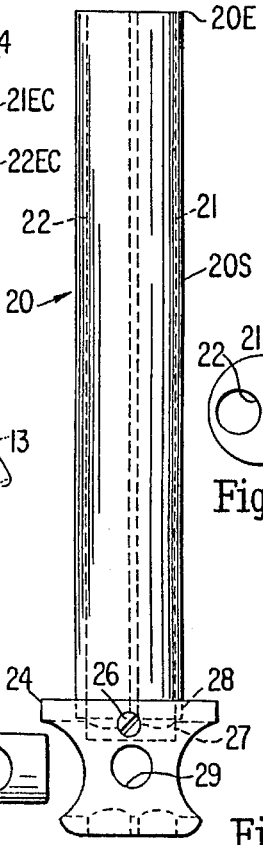
Fig.5a
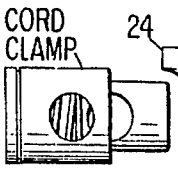
Fig.5c
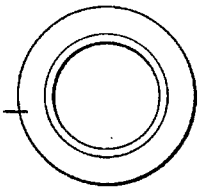
Fig.6a
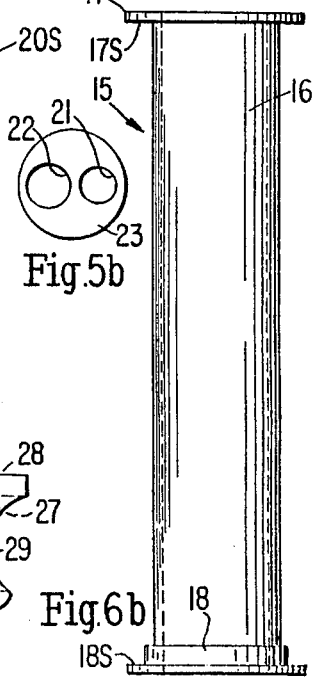
Fig.6b
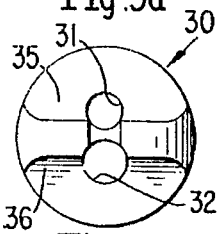
Fig.4a
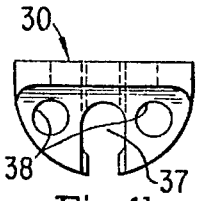
Fig.4b
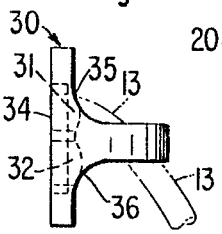
Fig.4c
Fig.5b
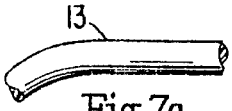
Fig.7a
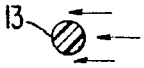
Fig.7b
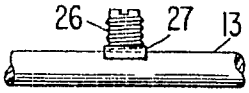
Fig.8

HIGH SPEED JUMP ROPE

BACKGROUND AND BRIEF DESCRIPTION OF THE INVENTION

The present invention relates, in general, to jump ropes and more particularly, to high speed jump ropes for sustained aerobic exercising.

A detailed analysis of various prior art jump ropes or skip ropes is set out in Everroad U.S. Pat. No. 4,385,759 which is incorporated herein by reference. In the Everroad patent, a jump rope is disclosed in which the handles are hollow cylindrical handle grip members open at each end and in which a pair of shouldered cylindrical bearing members are inserted in each end of the handle grip members. Each bearing member is arranged with a reduced diameter plug portion and has a through hole adapted to receive the skip rope. The rope is threaded through the hole in each bearing member and the free ends of the rope are knotted into a diameter sized to preclude the rope passing back through the hole. The bearing members and the material of the length of the rope have self-lubricating relationship to each other. Nylon, polypropolene, polyvinyl chloride are materials of which the handles and rope are constructed. In the Evenrod jump rope, the knotted end rotates and bears against one of the shouldered cylindrical bearing members, while the remainder of the handle is essentially stationary except for the hand/arm motions of the user. The length of rope can be adjusted by changing the knot position.

There are numerous disclosures in the art of jump ropes having handles with bearings to permit rotation of the rope in the handle. See, for example, U.S. Pat. Nos. 4,101,123; 4,136,866. La Sares U.S. Pat. No. 1,462,088 discloses a jump rope handle in which a hollow handle has a bore in which is loosely mounted a spindle which, in turn, is secured to one end of the rope so that when the rope is rotated, the handle member is essentially stationary and the spindle turns with the rope.

Jump rope or skip rope handles which are adapted to or incorporate rope length adjustment features is disclosed in German Patent 911,713 dated May 17, 1954. In this disclosure, various means are shown for securing an adjustable length of the rope so as to permit easy adjustment of the rope for the user. Similarly, Nissen U.S. Pat. No. 2,869,872 discloses an adjustable handle for a jump rope in which a flexible barrel member has a cap adapted to be positioned in one end of the barrel and a loop is positioned on the cap and extending interiorly of the barrel so that the end of the rope can be passed through a ring on the cap and be doubled-back or looped on itself and thereby wedge the rope in the adjusted position. However, in these disclosures the rope does not rotate in the handles.

The object of the present invention is to provide an improved jump rope, particularly a high rotational speed jump rope for sustained aerobic exercise. The jump rope according to this invention is of a plastic construction which will not corrode. It also provides for instant rope length adjustability which is particularly suited for institutional, health clubs and spas, etc. Moreover, the handles according to the invention accept a broad range of monofilament plastic rope diameters so that they are easily interchangeable so the user can selectively adjust the degree of aerobic or anerobic exercise desired. Moreover, in one adaptation of the invention, more than one rope could be used for a more intense work-out and exercising. Further, the user has many options available for configuration of the jump rope due to the handle design and thus the jump rope can be personalized. Moreover, since the handles are made out of a high density plastic such as nylon, Teflon™, Delran™, (all are synthetic resin polymers) they are moldable and virtually unbreakable and have high lubricity.

A further feature of the invention is that the "rope", in its preferred embodiment, is not of a woven material but, rather, is a small diameter (preferably ¼" to ⅜" diameter), smooth, preferably high density polyurethane material or rubber which has a smooth exterior so as to reduce the wind resistance and thus provide for ultrafast rotation. Moreover, because of the handle construction, the rope portion rotates freely with a spindle journaled in the handle thereby permitting this ultra fast rotation. The jump rope is light weight and, finally, incorporates comfortable foam grips so that extended use of the rope is possible. An angulation of rope off the handle transmits the user's rotation power more efficiently and eliminates rope wear-down and deterioration at the handle ends.

According to the invention, the handles are formed from a plastic spindle rod with one or a pair of parallel holes or bores running the entire length thereof and which is mounted or journaled for easy spinning or rotation within a cylindrical handle housing. This allows the rope to rotate substantially free of friction and thus avoid rope deterioration. In the preferred embodiment there are one or more axially extending offset holes in the rod so that the axis of the rope is off-center and locked to act as a crank and help initiate rotation and also, if desired, allow for use of two ropes where a pair of axially extending holes are provided. Preferably however, the extra hole provides a place to put excess rope or could be used as a place to mount the end caps and stabilize the rod within the grip handle. The off-set arrangement acts like a crank and transmits rope or cord rotation energy more efficiently and effectively resulting in a higher cord speed and less wrist fatigue.

Several knotless or knot-free modes of adjusting the length of the rope relative to the handle are disclosed herein. In one embodiment, a rope notch or clamp is built into an end cap. Not only does this feature stabilize the rope but it also sets the rope off at an angle from the handle and has a crank effect which helps initiation of rotation of the rope. A further embodiment of the adjustment feature works simply by inserting the rope in the empty off-set bore hole.

Another adjustment modification feature is the use of cord locks which can be inserted in a large hole of an end cap. The rope would run through the cord lock and out the end of the end cap. Cord locks can also be used outside of the handle separately or in conjunction with each other by being stabilized in the radius curves. In still a further embodiment, a set screw in one of the end caps of the spindle assembly, with or without clamp member or saddle can be used to prevent rope movement relative to the rotary spindle. Finally, the rope can also be adjusted and/or angled in several configurations by inserting it through small holes in the end cap. These adjustment features or embodiments can all be used separately or in conjunction with each other.

DETAILED DESCRIPTION OF THE DRAWINGS

Figure 8A:
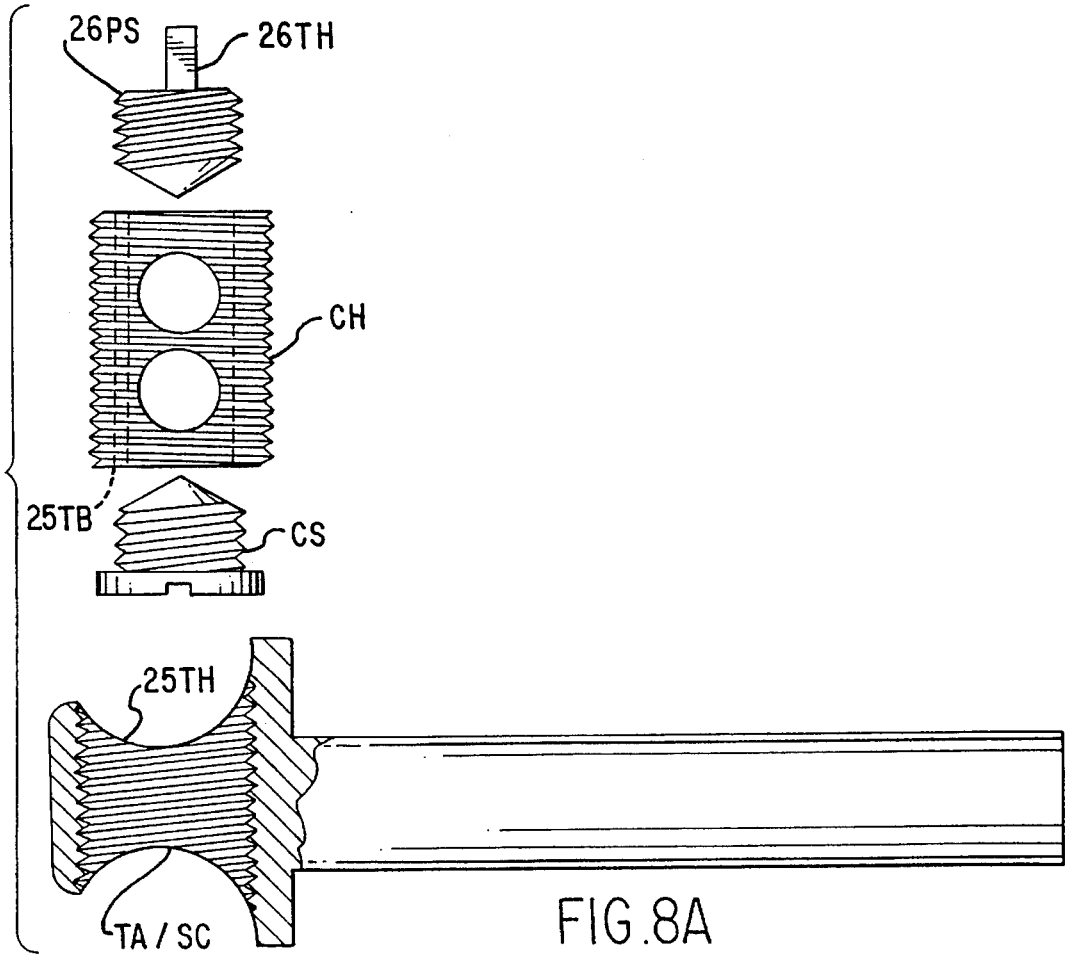
Figure 9:
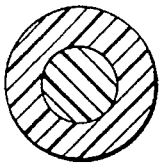

The above and other objects, advantages and features of the invention will become more apparent when considered with the following specification and accompanying drawings wherein:

FIG. 1 is a perspective view of a jump or skip rope incorporating the invention, FIG. 2 is a partial sectional view of a handle incorporating the invention, FIG. 3*a* is an end view of a jump rope handle spindle end cap, FIG. 3*b* is a top plan view of the jump rope handle spindle end cap, FIG. 3C is a side elevational view of the jump rope handle spindle end cap, FIG. 4*a* is an end view of the opposite jump rope handle spindle end cap, FIG. 4*b* is a top view of said other jump rope handle spindle end cap, FIG. 4*c* is a side elevational view thereof, FIG. 5*a* is a side elevational view of the jump rope spindle rod with connected end cap, FIG. 5*b* is an end view of the jump rope handle spindle incorporating the invention, FIG. 5*c* shows a modification wherein a pair of monofilament cords are carried by each handle, FIG. 6*a* is an end view of the jump rope grip handle, FIG. 6*b* is a side view of the jump rope grip handle with the foam grip material removed, FIG. 6*c* is a end view of the grip handle cap, FIG. 7*a* is a view of the rope and FIG. 7*b* shows a section thereof, FIG. 8*a* shows the set screw saddle mode of adjustably securing the rope to the rotary spindles, FIG. 8*b* shows a further embodiment of the invention, and FIG. 9 illustrates a polyurethane rope cored with a fluent filling.

DETAILED DESCRIPTION OF THE INVENTION

In FIG. 1, a jump rope 10 incorporating the invention has a pair of handles 11 and 12 joined by a length of rope 13 and, in the preferred embodiment to be described hereafter, one or both handles have means for quickly and easily adjusting the length of the jump rope between the handles 11 and 12, respectively. While each of the handles may, in the preferred embodiment, be identical, it will be appreciated that the length adjustment and end storage features need be applied to only one of the handles and one end of rope 13 may be secured to one or the other handle in a permanent fashion.

THE HANDLES

A preferred embodiment of a handle is illustrated in assembled sectional view in FIG. 2 wherein a handle body member 15 has a hollow cylindrical grip member 16 which has bearing end shoulders 17 and 18, respectively, and grip member 16 receives foam grip member 19. Member 16 and end shoulder members 17 and 18 may be made by a single injection molding or may be machined out of suitable plastic material. Preferably the material is a low friction material such as nylon, Teflon®, or is coated with a low friction material or self-lubricating material at the hollow bearing surface 16B such as Teflon®. The grip material 19 is preferably a flexible foam or rubber of the type used to make bicycle handle grips, for example, which is assembled to the grip handle 16 and held in place by shoulders 17S and 18S on members 17 and 18. The exterior surfaces 19ES of grip material 19 may be textured in some cases to fit the user's grip or palm and finger configurations or grip handle 6 could be injection molded to include textured grip properties. The jump rope handle spindle 20 (see FIG. 5*a*) has a central shaft 21, which is slightly smaller in diameter than the diameter of the bore of handle member 16, has one or more bore holes 22, 23 therein of different diameters, bore hole 22, for example, being about 9/32" in diameter and bore hole 23 being about 11/32" (a useful range for bore holes being from about 1/4" to about 3/8" (5/8" if spindle is bored with one large off-set hold) to accommodate the differing sizes of the jump rope 13 (to be described more fully hereafter and thus permit the user to selectively adjust the degree of anerobic or aerobic exercise desired). Spindle member 20 is formed with an integral end cap 24 (see FIGS. 3*a*, 3*b* and 3*c*). Spindle end cap 24 is integral with spindle rod 21 and the bore holes 21, 23 pass directly therethrough, as indicated at 21EC and 22EC (FIG. 3*a*). In addition, end cap 24 has a large transverse aperture 25 which, as will be described more fully hereinafter has a diameter for frictionally retaining a cord clamp therein which may be positioned over one of bores 21 or 22, respectively, so as to clamp the end of the rope in any adjusted position to thereby adjust the length of the rope for individual users. Surface handles can be set on the cord in either direction, cord clamps inside or outside respective to length of cord. Large concavities 24C on each side allow the thumb and forefingers to squeeze the cord clamp and also to position it over one or the other of rope receiving bore holes 22 and 23. Alternatively, instead of a cord clamp, the cord may be clamped by a set screw 26 (FIG. 8*a*) which causes a cord saddle 27 fitted in a cord saddle slot 28 in end cap 24, saddle 28 being complementarily internally curved to accommodate a cord passing through passages 21 and 22. In FIG. 8*a*, a large threaded plastic set screw 26PS having a turning handle 26TH is threadably engaged with threaded transverse bore 25TB to engage and clamp a cord passing through the axially extending bore hole. It will be appreciated that if desired, the user may use two monofilament plastic ropes MPR1 and MPR2 or cords, one of one diameter, one of another diameter shown in section in FIG. 5*c*, for a more intense work-out and in which case, both cords would be locked by a common clamp saddle 27. Finally, end cap 24 may be provided with a further transverse bore 29 such that the cord passing through bore 21 may be pulled through and one of the concavities and bent around to pass through bore hole 29 and thereby secure the cord in place in an adjusted position.

As a further alternative for securing the cord in place in spindle 20, the cord may pass through bore 21 and end cap bores 21EC and simply loop-back into bore 22EC, for example.

A second end cap 30 is secured to the opposite end of spindle assembly 20 preferably by adhesive after passing spindle shaft 20S through the bore and handle grip 16. End cap 30 and end cap 24 both have base surfaces 24B and 30B, which form smooth bearing surfaces against end caps 17 and 18, respectively, so that the handle grip 16 is essentially stationary relative to free rotation of the spindle assembly 20 (including end cap 30) upon rotation of the rope. The handles only move by movement of the user and of course, any forces (centrifugal) generated by rotation of the rope.

Referring now to FIGS. 2 and 4*a*, and 4*b* and 4*c*, end cap 30 has a pair of bore holes 31 and 32 which are aligned with bore holes 21 and 22 in spindle 20 and have the same diameters. The cord 13 thus will pass through either bore hole 31 or 32 or, if two ropes are used, through both bore holes. In the typical embodiment, however, a single rope is used and passes through one or the other bore holes, bore hole 31, for example. As shown in FIG. 4*c*, end cap 30 has a recess 34 for receiving end 20E of spindle 20 and may be adhesively secured or bonded thereto or complementary threads could be formed in the end cap and spindle end or otherwise mechanically secured. In addition, end cap 30 is shaped to have a pair of concavities 35, 36 and a notch 37 which has an entranceway defining protuberances 37P on each side thereof and forms a rope latching or securing notch as an additional means of securing the rope 13 against rotation relative to the spindle 20 and thereby permit easy and rapid adjustment thereof. In this embodiment, as shown in FIG. 4*c*, rope 13 passes through bore 21, bore 31, and is forced down through opening 37-O and partially forces back the protuberances 37P and with the rope 13 itself being plastic giving, forces itself into the notch 37. Thus, as shown in FIG. 4*c*, the rope is bent at a sharp angle so as to lock it in place and form a crank relative to the handle so as to provide in some cases a more effective utilization of the user's energy in rotating the rope and thereby enhancing the aerobic exercise. However, it will be appreciated that this feature need not be utilized by the user if it is not desired. Moreover, the end cap 30 has a pair of apertures 38 which may also be utilized to pass the rope through and prevent movement of the rope relative to the handle and also achieve a crank configuration for the handle.

As noted above, aperture 25 is designed to receive a cord clamp of the type disclosed, for example, in U.S. Pat. No. 4,328,605. A cord clamp with a high tension spring would work much more effectively for securing the cord making it a better means of adjustment. However, because this adds to the cost of the unit, it is not as preferred as the other embodiments disclosed herein. The basic objective is to assure that the rope does not rotate relative to the spindle and that the spindle is free to rotate in the handle grip member 15.

THE ROPE

As used herein, the term "rope" is intended to mean a rope member or an elongated member useful for jumping and in the preferred embodiment, is a monofilament member which has a smooth exterior surface. As earlier described herein, one may utilize at least a pair of ropes in a single jump rope, one passing through each of the bore holes 21, 22 and of the same or different diameters. In the preferred embodiment, the jump rope is a monofilament polyurethane cord member which has been extruded and has no bubbles or other imperfections therein and has a diameter between about ¼" to about ⅜". A one-holed spindle could allow for an off-set hole of 21/32" that could allow a cord of ⅝" diameter to be used. As shown in FIG. 7*b*, the rope is circular i section (e.g., it is not oval or oblong) and thus has a low wind resistance. In the embodiment shown herein, bore 22 is 9/32" in diameter to receive a ¼" polyurethane rope and bore hole 23 is 11/32" to receive a 5/16" polyurethane rope or smaller.

FIG. 9 illustrates a section of a polyurethane rope cored or filled with a fluent weighting material such as lead or liquid such as water and sealed at the ends thereof.

Thus, there has been disclosed and illustrated preferred embodiments of the invention in which the jump rope is designed as a conventional jump rope which means that it is not a heavy or weighted-type jump rope such as is disclosed in Hinds U.S. Pat. No. 4,293,125 and is capable of extremely high rotational speed due to the dense weight and small diameter of the solid extruded or monofilament-type of rope or cord. The jump rope according to this invention is a perfect rope for continuous aerobic-type work-outs (10 min. to 2 hrs. or more) or high speed sprints (10 secs +). The handles allows for easy grips for long and extended work-outs and for different sizes (diameters) of rope, which, in turn, permits heavier cord use that make for a much more intensified anerobic (upper body strengthening-type work-out) and aerobic work-out. The jump rope according to the invention is the most efficient in energy transfer from the body to the rope by allowing one to achieve a high rotational speed with little effort thus allowing one to more easily enjoy prolonged aerobic work-outs. This is an advantage to anyone at any level of jump rope proficiency. The rope's instant cord length and configuration adjustment features make it an ideal jump rope for institutions, schools, health spas, etc. Because of the moldable features, it can be easily made and at moderate cost.

The angular angulation of the rope relative to the handles (in the embodiment and method illustrated in FIG. 4*c*) transmits the user's rotational power in use more efficiently and eliminates rope wear-down. The instant rope length adjustability while still providing for rope rotation relative to the handle without friction on the rope itself significantly enhances the operation of the jump rope according to the invention. The handles accept a broad range of rope diameters so that the ropes may be easily interchanged. This permits more than one rope to be used for more intense work-outs. Moreover, the user has many options available for configuration of the rope due to the handle design so that the user may personalize his jump rope. Because the rope is made essentially of all plastic, it is virtually unbreakable. The ultra-fast rope rotation is due to the slim yet dense, smooth-surfaced, mono-filament polyurethane rope. Other types of rope material and the invention could be used and can be sold by parts or disassembled for easy replacement parts. It is essentially light-weight and great for institutional use due to the instant adjustability and, it is comfortable to use because of the foam grips or most any grip material available.

SUMMARY OF THE INVENTION

A spindle rod with two off-set of center parallel cord receiving holes running through its entire length spins freely within a grip handle allowing the cord to rotate free of friction that would cause it to twist and deteriorate. The off-set holes in the spindle rod perform several functions. They act as a crank mechanism allowing for more efficient cord rotation energy transfer, provide a place to store cord ends (means of length adjustment), allows for use of two ropes, and also could be used as a place to mount end caps.

There are several cord length and configuration adjustment features simplistically designed within the handles. The first of which is by clamping the cord in the notch on end cap 2. This feature stabilizes the cord at a desired length and also sets the cord off at a 90 degree angle from the handles which, by acting as a crank, allows for more efficient and effective use of cord rotation energy. Another adjustment feature works by simply inserting excess cord length in the empty off-set spindle rod holes. Cord length adjustments can also be made with the use of cord clamps. A cord clamp can be inserted in the large bore hole of an end cap. The cord would run through the cord clamp then out of the end of the end cap. Cord clamps can also be used outside of handles by being stabilized within the radius curves. Lastly, the cord can be adjusted lengthwise and/or angled in several configurations by inserting it through the small holes in both end caps of both handles. All of these described features can be used separately or in conjunction with each other.

SUMMARY OF THE ADVANTAGES OF THE JUMP ROPE OF THIS INVENTION

1) Ultra high speed rotational capabilities due to slim dense polyurethane monofilament cord in spindles journaled for free rotation in comfortable grip handles.

2) Crank angle cord configuration adjustments within the handles transmit cord rotation energy more efficiently and effectively resulting in a higher cord speed and less wrist fatigue (crank concept).

3) Many variations for instant adjustment of rope length and rope configuration built into handles.

4) Handles easily accept cords of different diameters which allows the user to quickly adjust the degree of exercise intensity. (Product could be sold with optional cords for higher intensity workouts or for the cosmetic appeal of different colors.)

5) Perfect for institutional use (schools, gyms, health spas, training camps) due to instant length adjustability features.

6) More than one rope could be used for a more intense workout.

7) Handle technology allows the invention to bridge the gap between conventional jump ropes and heavy, weighted type jump ropes.

8) Other types of cord material can easily be used.

9) The aesthetic design of this jump rope and the wide array of colors, its materials and parts can come in give it an extremely high tech/high fashion appeal.

10) Made of unbreakable materials.

11) Lightweight, yet has a solid quality feel to it.

12) Comfortable foam grips (handles accept a variety of available grip materials).

13) Can be sold assembled, disassembled, or by parts.

While there has been shown and described a preferred embodiments of the invention, it will be appreciated that the invention may be embodied in other specific forms without departing from the spirit and scope of the invention as defined in the claims appended hereto.

What is claimed is:

1. A high speed exercising jump rope comprising a smooth, circular monofilament plastic rope, a pair of handles, each handle having:

1) a hand grip member, 2) a rotary member journaled for rotation in said handle member about an axis of rotation, at least one of said rotary members including adjustment means for adjustably securing said rope at different positions relative to the end thereof to adjust the effective length thereof.

2. The jump rope defined in claim 1 wherein said adjustment means includes an aperture in said rotary member, said aperture being offset relative to the axis of said rotary member, and adapted to receive an end of said rope.

3. The jump rope defined in claim 1 wherein said adjustment includes a saddle clamp and screw means threadably engaged with said rotary member for driving said saddle clamp against said monofilament plastic rope and clamp same to said rotary member.

4. The jump rope defined in claim 1 wherein said hand grip member has an axial hole therethrough, said rotary member is a spindle extending through said axial hole in said hand grip member, said spindle having at least one bore hole therethrough which is offset from the axis of said rotary member and adapted to receive said monofilament rope, and means forming a rope notch for receiving said monofilament plastic rope at an angle to said rotary axis whereby said cord is bent at an angle to said bore hole in said spindle.

5. The jump rope defined in claim 2, or 4 wherein said rotary members have off-set bore holes with diameter 3/8" to 21/32" so as to accommodate larger diameter ropes.

6. The jump rope defined in claim 1 wherein said hand grip member has an axial cylindrical bearing hole therethrough, said rotary member being a spindle rotatably mounted in said cylindrical bearing hole, at least one bore hole in said spindle for receiving said monofilament rope.

7. The jump rope defined in claim 6 wherein there are at least a pair of said bore holes in said spindle.

8. The jump rope defined in claim 4 wherein there are at least a pair of said bore holes in said spindle.

9. The jump rope defined in claim 7 wherein said bore holes have different diameters.

10. The jump rope defined in claim 7 wherein there are a pair of said ropes, the respective ends of one each rope being received in each spindle and in a selected bore hole therein, respectively.

11. The jump rope defined in claim 6 wherein said spindle and said handle grip have low friction synthetic resin polymer bearing surfaces therebetween.

12. A high speed exercising jump rope comprising a smooth, circular monofilament plastic rope, a pair of handles, each handle having:

1) a hand grip member, 2) a rotary member journaled for rotation in said handle member about an axis of rotation, at least one of said rotary members including adjustment means for adjustably securing said rope at different positions relative to the end thereof to adjust the effective length thereof and wherein said rotary member includes at least a pair of substantially parallel axial bores therethrough and substantially parallel to said axis of rotation, one of said bores receives said rope in a first pass through in one direction and the other of which receives the end of said rope going in an opposing direction and constitutes means for adjusting the length of said rope between said handles.

13. A high speed exercising jump rope comprising a smooth, circular monofilament plastic rope, a pair of handles, each handle having:

1) a hand grip member, 2) a rotary member journaled for rotation in said handle member about an axis of rotation, at least one of said rotary members including adjustment means for adjustably securing said rope at different positions relative to the end thereof to adjust the effective length thereof and including said rotary member having a bore therethrough, cord clamp means mounted in an end of said rotary member and alignable with said axial bore for adjustably securing said rope at different positions in said axial bore and adjust the length of said rope between said handles.

14. The jump rope defined in claim 12 wherein said rotary members have at least a pair of substantially parallel axial bores of different diameters, respectively, so as to accommodate different sizes of monofilament rope.

15. The jump rope defined in claim 14 wherein there is a monofilament jump rope in each of said at least a pair of parallel axial bores.

16. A high speed exercising jump rope comprising a smooth, circular monofilament plastic rope, a pair of handles, each handle having:

1) a hand grip member, 2) a rotary member journaled for rotation in said handle member about an axis of rotation, at least one of said rotary members including adjustment means for adjustably securing said rope at different positions relative to the end thereof to adjust the effective length thereof and wherein said monofilament rope is aerodynamically smooth and free of discontinuities along the length thereof and is selected from extruded polyurethane and rubber.

17. A high rotational speed jump rope for sustained aerobic exercise comprising, 1) a high density monofilament plastic rope having a diameter between about ¼" and about ⅝", a circular, aerodynamically smooth exterior surface and a pair of ends, 2) a pair of grip handles, each grip handle including:

a) low friction bearing means mounted for rotation in said handle, and b) means for securing an end of said plastic rope to said low friction bearing means so that said rope and said bearing means can rotate relative to said grip handle at high speeds when operated by a user.

18. In a jump rope assembly having a pair of handles, rotary bearing means mounted in each said handle and a jump rope having ends secured to said bearing means, respectively, the improvement wherein said jump rope is comprised of a smooth-surfaced small diameter high density polyurethane so that ultra-fast rotation is achievable thereby, and knotless means for one of said bearing means for adjusting the length of said rope between handles.

19. In a jump rope comprising a pair of grip handles and a spindle bearing means rotatably mounted coaxially in said grip handles, respectively, and a rope with ends secured to said respective spindle bearing means, the improvement comprising:

said rope being a high density, monofilament plastic having a small diameter circular in cross-section and having a smooth external surface to provide a low wind resistance and permit ultra-fast rotation thereof by a user.

20. The jump rope defined in claim 19 wherein said rope is about ¼" in diameter and is made of extruded polyurethane.

21. The jump rope defined in claim 19 wherein each of said grip handles has an axial bore therethrough, said spindle bearing means is a spindle shaft journaled for free rotation in said axial bore, the further improvement wherein said spindle shaft has at least one rope receiving bore hole therein and means for adjustably securing said rope in said bore hole.

22. The jump rope defined in claim 21 wherein said spindle has inner and outer ends, said at least one bore hole extends through said spindle from said inner end to said outer end and substantially parallel to the axis of rotation of said spindle and off-set therefrom, and notch means formed at the inner end of said spindle for receiving and securing said rope at an angle transverse to said rotary axis such that said rope operates as a crank.

23. The jump rope defined in claim 22 including at least a second bore hole in said outer end of said spindle for receiving and storing a loose end of said rope.

24. The jump rope defined in claim 23 wherein said second bore hole has a larger diameter than the first said bore hole.

25. In an institutional or health club jump rope having a length of rope with a pair of ends, a pair of grip handles, rotary means mounted for rotation in said grip handles, and means for securing the respective ones of said rotary means to one of said pair of ends respectively, the improvement wherein said jump rope is an extruded monofilament plastic having a circular section with smooth external surfaces and wherein said means for securing includes means for adjustably securing said ends along said length of rope to adjust the length of said rope between said handles for different size users.

26. In an aerobic jump rope having a length of rope with a pair of ends, a pair of grip handles, rotary means mounted for rotation in said grip handles, and means for securing the respective ones of said rotary means to one of said pair of ends, the improvement wherein said means for securing is adapted to receive a plurality of rope diameters so as to permit the user to adjust the degree of aerobic exercise desired.

* * * * *